United States Patent [19]

Bailey, Jr. et al.

[11] Patent Number: 4,943,210

[45] Date of Patent: Jul. 24, 1990

[54] PUMP CONTROL SYSTEM, LEVEL SENSOR SWITCH AND SWITCH HOUSING

[76] Inventors: James R. Bailey, Jr., 2447 Lexington Rd., Lancaster, Ky. 40444; Jean D. Ashcraft, 108 Robin Rd., Nicholasville, Ky.

[21] Appl. No.: 308,934

[22] Filed: Feb. 7, 1989

Related U.S. Application Data

[63] Continuation-in-part of Ser. No. 252,764, Oct. 3, 1988, abandoned.

[51] Int. Cl.[5] ..... F04B 49/00

[52] U.S. Cl. ..... 417/12; 417/40; 417/44; 200/84 C

[58] Field of Search ..... 417/12, 38, 40, 36, 417/44, 45; 200/84 C

[56] References Cited

U.S. PATENT DOCUMENTS

| | | | |
|---|---|---|---|
| 2,976,807 | 3/1961 | Hill | 417/40 |
| 3,132,592 | 5/1964 | Rudy et al. | 417/38 |
| 3,204,230 | 8/1965 | Hosford, Jr. | 200/84 C |
| 3,285,183 | 11/1966 | Hemlree et al. | 200/84 C |
| 3,413,429 | 11/1968 | Yost | 417/38 |
| 3,453,962 | 7/1969 | Strader | 417/12 |
| 3,679,325 | 7/1972 | Yost | 417/12 |
| 3,938,910 | 2/1976 | Douglas | 417/38 |
| 3,963,374 | 6/1976 | Sullivan | 417/12 |
| 4,020,481 | 4/1977 | Nakagawa | 200/84 C |
| 4,081,639 | 3/1978 | Tice | 200/84 C |
| 4,318,674 | 3/1982 | Godbey et al. | 417/36 |
| 4,441,860 | 4/1984 | Tsujimoto | 200/84 C |

FOREIGN PATENT DOCUMENTS

| | | | |
|---|---|---|---|
| 1190541 | 4/1965 | Fed. Rep. of Germany | 200/84 C |
| 0019990 | 1/1986 | Japan | 417/36 |

*Primary Examiner*—Carlton R. Croyle
*Assistant Examiner*—D. Scheuermann
*Attorney, Agent, or Firm*—King and Schickli

[57] ABSTRACT

A control system for a pump includes a level sensor switch that is positioned along a production string in an oil well shaft. The level sensor switch is protected from damage by inner and outer housings. A control circuit responsive to the level sensor switch is also provided. The control circuit includes an adjustable timer that is located at ground level remote from the harsh environment of the oil well shaft. The timer controls the operation time of the pump during each pumping cycle.

12 Claims, 3 Drawing Sheets

12
10
GROUND LEVEL
34,35
S
38
48
26
20
14
40
48
16
P

PUMP CONTROL SYSTEM, LEVEL SENSOR SWITCH AND SWITCH HOUSING

This is a continuation-in-part of application Ser. No. 252,764, filed Oct. 3, 1988, now abandoned.

TECHNICAL FIELD

The present invention relates generally to control systems and more particularly with improvements to a control system for operating an oil well pump. The invention also relates to a housing specially adapted to protect the oil well shaft components of the control system from impact damage during initial positioning in and residence time within the shaft.

BACKGROUND OF THE INVENTION

A number of different types of pump assemblies are utilized for recovering liquid from subterranean areas, such as crude oil from an oil well shaft or bore hole. These include walking beam pump apparatus and electric motor and pump assemblies that may be positioned above ground so as to lift the oil from the subterranean producing strata through a production string. Alternatively, a pump and motor assembly may actually be positioned in the shaft near the producing strata in a working barrel connected to the production string. In operation the pumps remove liquid from the shaft or cavity surrounding the intake pipe at the end of the production string and pump the liquid through the production string to a storage tank or other facility where it is held for further processing.

Typically, pumps of the types described have a pumping capacity that exceeds the rate at which oil and liquid flows from the producing strata into the shaft. As a result, continuous operation of the pumps causes the shaft surrounding the intake pipe to be emptied of liquid. Of course, operation of a pump in a cavity or shaft emptied of liquid is undesirable. It results in unnecessary and excessive pump wear and possible damage. The energy used to operate the pump is also effectively wasted and production efficiency is significantly reduced.

Recognizing these problems, a number of systems have been developed for providing intermittent operation of a pump when the cavity surrounding the intake pipe is filled with the desired level of liquid.

In one approach, the operation of the pump is controlled exclusively by a timer. The rate of liquid production from the producing strata is studied to determine the best timer settings. For example, the timer may be adjusted so that the pump is operated every four hours for a period of twenty minutes. As long as the producing strata continues to produce liquid at a substantially constant rate, this type of pump apparatus may be operated efficiently. However, it should be appreciated that often the rate of liquid production from producing strata varies from season to season, month to month, and even day to day. As a result, a pump apparatus exclusively controlled by a timer must be carefully monitored in order to ensure that the pump is being operated at maximum efficiency: that is, only when sufficient liquid is present in the cavity to allow the desired pumping. Unfortunately, this is an inconvenient, labor intensive and time consuming task.

An alternate approach providing intermittent operation of a pump includes the utilization of a pair of liquid level sensors that are positioned in the oil well shaft.

One level sensor is positioned at the maximum desired liquid level and the other sensor is positioned at the minimum desired liquid level in the shaft. When the liquid level in the shaft reaches the upper or maximum level sensor, a switch is closed and pump operation is initiated to recover liquid from the shaft. Once the liquid level drops just below the lower or minimum level sensor, pump operation is discontinued. Such a pump control system is described and claimed in, for example, U.S. Pat. No. 3,132,592 to Rudy et al.

While a level sensor control apparatus of the type disclosed in the Rudy et al patent is effective in providing more efficient operation of the pump even when liquid production rates from the strata vary to a significant degree, the apparatus is not without its drawbacks. The primary concerns relate to overall reliability. The two level sensors/switches must be carefully mounted along the production string at desired locations. The string must then be carefully lowered into the oil well shaft. During lowering, the switches may come into contact with the side of the shaft. If the position of either of the switches is moved relative to the other, the operational efficiency of the pump may be adversely effected. Alternatively, one or both of the switches may, in fact, be damaged through, for example impact with the side wall of the shaft. If this occurs, the pumping control system is effectively made inoperative.

It should also be appreciated that, even when properly installed, the level sensors/switches are exposed to severe operating conditions in the oil well shaft. Subterranean pressure conditions may at times reach 1,000 psi or more. In addition, the sensors/switches are often contacted by chemicals leached from the surrounding strata. Often, strong acids are released which over time have a deleterious effect on switch operation. Again, as mentioned above, if either switch becomes damaged, the control system is effectively rendered inoperative. Of course, because of the exposure of the switches to the severe elements in the oil well shaft, the chances of one of the switches becoming inoperative over time are significant.

Yet another alternative pump control system includes a single level sensor switch providing a timed operation of the pump. Such a device is described and claimed in U.S. Pat. No. 3,413,429 to Yost. The Yost patent discloses a switch including two chambers each having a diaphragm. As liquid from the producing strata enters the oil well shaft, the pressure exerted on the diaphragm of the first chamber increases forcing fluid within the first chamber through a one-way valve into the second chamber. This causes a switch to close and the initiation of the pumping operation. As liquid is recovered from the shaft, the pressure exerted on the diaphragm of the first chamber decreases. As a result, the pressure of the fluid in the first chamber decreases. Eventually fluid pressure in the second chamber is sufficient to overcome the force of a bleed-off valve spring. Fluid flows through the bleed-off valve from the second chamber to the first chamber until pressures in the two chambers are equalized. At that point in time pump operation is terminated.

While the control apparatus provided for in the Yost patent functions to provide effective operation of the pump, it should be appreciated that the structure provided for the switch is unduly complicated and somewhat unreliable. For example, the diaphragm of the first chamber is exposed to the harsh environment of the oil well shaft. It could either be damaged as, for example, by puncturing during positioning of the production string in the shaft or by the acidic and corrosive chemicals leached from the surrounding strata.

It should further be appreciated that the pump control described in the Yost patent does not provide the desired flexibility to allow the well operator to maintain maximum production efficiency in response to changing conditions. More particularly, the strenth of the spring of the bleed-off valve determines the length of time the pump is in operation. Since the bleed-off valve spring is located underground in the shaft, it cannot be readily changed or adjusted. As such, the operation of the pump cannot be adjusted to, for example, recover a different volume during a particular pumping cycle such as when necessary to maintain a certain static pressure above a producing zone. The device can also not be adjusted to meet changes in desired production quotas. As such, a need is identified for an improved oil well pump control system.

SUMMARY OF THE INVENTION

Accordingly, it is a primary object of the present invention to provide a control system for an oil well pump overcoming the above-described limitations and disadvantages of the prior art.

Another object of the present invention is to provide a control system for an oil well pump that reliably provides more efficient operation of the pump.

Yet another object of the present invention is to provide a control system for an oil well pump that serves to increase production from the well while eliminating unnecessary pump wear so as to thereby increase pump service life.

Still another object of the present invention is to provide an improved shield to protect a liquid level sensor from impact damage during initial positioning and residence of the sensor within an oil well shaft.

Still another object of the present invention is to provide a control system for an oil well pump exhibiting improved dependability by having only a single level sensor located within the harsh environment of the shaft and a remotely located control circuit including a timer.

An additional object of the present invention is to provide an oil well pump control system of simple construction that is readily adjustable to provide the necessary time of operation of the pump to recover a specific quota of liquid from the well or maintain a certain static pressure of liquid in a well above a producing zone.

To achieve the foregoing and other objects, and in accordance with the purposes of the present invention as described herein, an improved control system is provided for pumps adapted for pumping liquid from an oil well shaft through a production string. The control system includes a means such as a pressure sensitive switch or float switch for sensing the liquid level in the oil well shaft. One such float switch is available from the Madison Company under the model designation M4500. This switch includes a stem and float. Within the stem is a normally open reed switch. Within the float is a ring shaped magnet that surrounds the stem. As the float is buoyed upward by a rise in the liquid level, the magnet becomes aligned with and surrounds the reed switch in the stem. When this occurs, the magnetic force produced by the magnet in the float serves to force the reeds in the switch together, closing the switch. A control circuit is provided, preferably at an above ground location remote from the harsh environment of the oil well shaft. The control circuit is responsive to the level sensor switch. More particularly, once the liquid in the shaft reaches a particular level, the sensor switch closes activating a timer in the control circuit.

The timer controls the operation of the pump. More particularly, the timer may be set so that during each cycle of the pump the pump operates for a specific period of time to pump a specific quota of liquid from the well. Alternatively, a certain amount of liquid may be retained in the well shaft in order to maintain a certain desired static pressure above a producing zone. In any event, the timer is always adjusted so that pump operation is terminated before the shaft in the area of the pump intake is empty of liquid. In this way, unnecessary wear and tear on the pump is avoided. Further, maximum operating efficiency is maintained.

A housing is provided to encase the sensor switch and protect it from impact damage when positioned in the oil well shaft. The level sensor switch housing includes an inner housing and an outer housing having a recessed cavity for receiving and holding the inner housing and level sensor switch. A substantially U-shaped mounting bracket is provided at each end of the outer housing. This bracket is adapted for engaging the production string.

A pair of mounting lugs are also provided. One lug depends from the outer periphery of the outer housing at each end. Each lug extends over and converges toward the U-shaped mounting brackets associated with the ends of the outer housing. At the distal end of each lug is a mounting tab also adapted for engaging the production string.

Clamps are provided for fixing the housing and switch to the production string. More specifically, the clamps take the form of band clamps. One band clamp is looped around each U-shaped mounting bracket, each mounting tab and the production string. The bands are then tightened to firmly seat and fix the housing and level sensor switch to the production string at a desired position above the intake of the pump.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
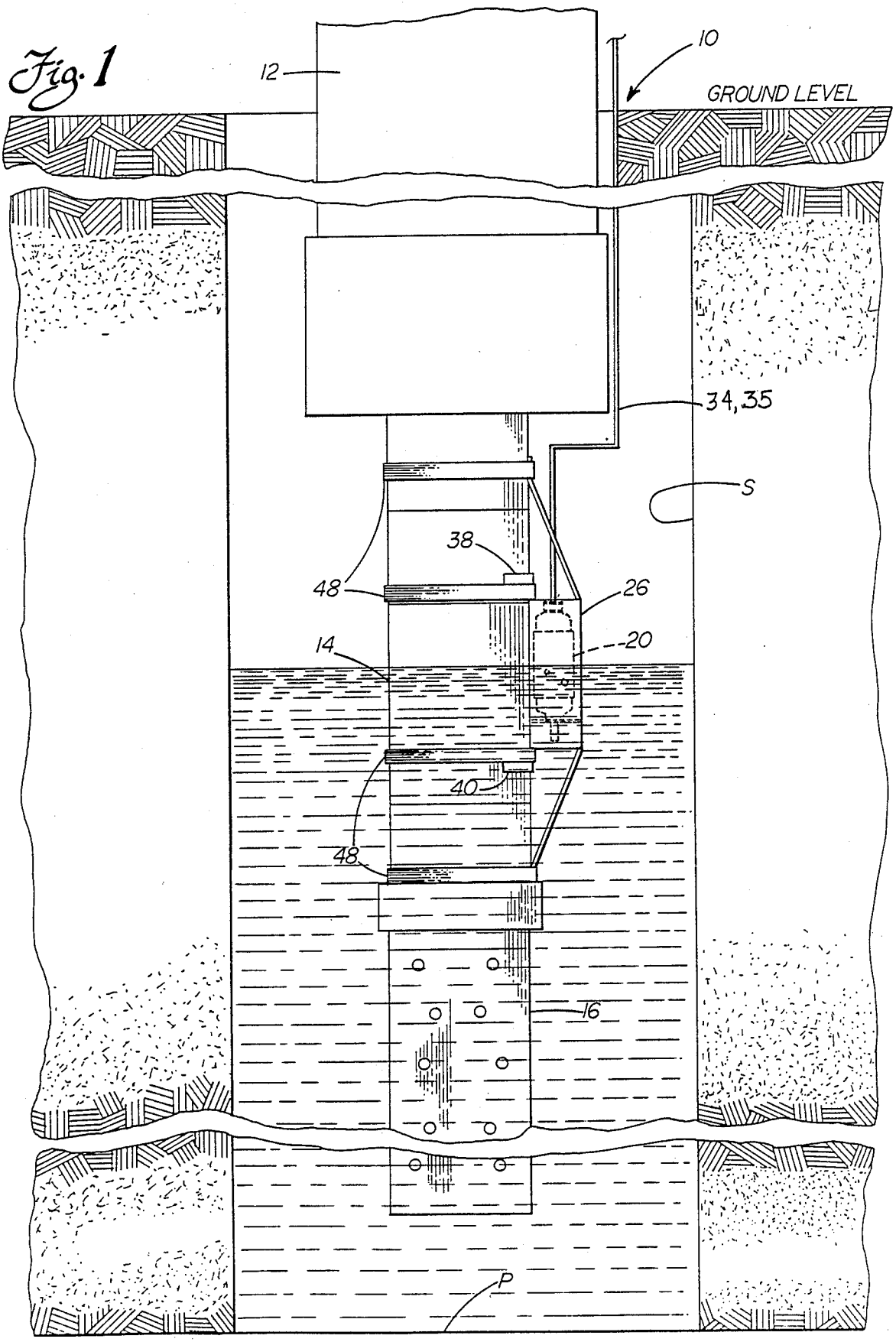
FIG. 1 is a cutaway diagrammatical view of a oil well shaft showing a production string and the control system of the present invention.

Reference is now made to FIG. 1 diagrammatically showing the improved pump control system 10 of the present invention. As described in greater detail below, the control system 10 controls the operation of a pump for recovering liquids such as crude oil from an oil well shaft S.

As shown in FIG. 1, the shaft S extends from ground level down to the producing strata P. A production string 12 of tubing extends downwardly through the shaft from a storage facility not shown to a pump 60 positioned within the working barrel 14. The working barrel 14 is connected to the end of the production string 12 and is positioned in the shafts above the producing strata P. A perforated intake pipe 16 extends from the distal end of the working barrel 14. When in operation the pump serves to pull liquid in the shaft S through the perforated intake pipe 16 and pump the liquid through the production string 12 to the storage facility.

While the control system 10 of the present invention will be described for operating a pump of the type positioned within the oil well shaft as described above, it should be appreciated that the control system is equally applicable and adapted for operation of above ground pumps such as the well known walking beam pumping apparatus. The description of the invention being utilized with an in-shaft pump is only for purposes of illustration and application of the control system of the present invention is not intended to be limited thereto.

The control system 10 of the present invention includes a liquid level sensor switch 18. This sensor switch 18 may take the form of, for example, a pressure responsive switch that closes in response to the increased pressure placed on the switch by a rising liquid level in the shaft S. Alternatively, and preferably, the level sensor switch 18 is in the form of a magnetic float switch.

Figure 5:
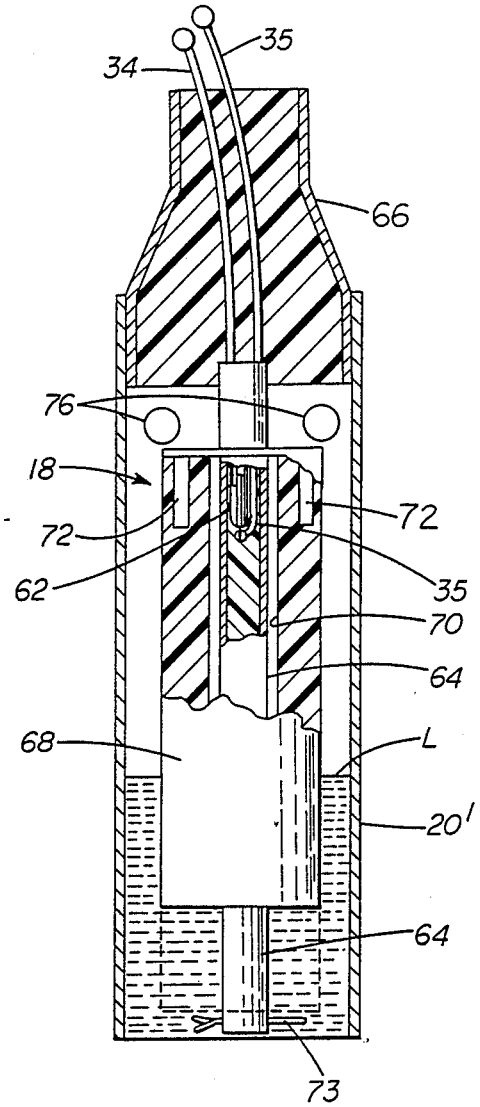
FIG. 5 is a cross-sectional view of a float switch mounted in an alternative inner housing with an open bottom.

More specifically, as shown in FIG. 5, the magnetic float switch 18 may include a normally open reed switch 62 mounted within a central stem 64 formed of a nonferromagnetic material such as brass. The reed switch 62 may be held in position within the stem 64 by any number of means. For example, as shown in the figure, the stem 64 and bell top 66 may be filled with a non-shrink epoxy material. Once this material sets, the reed switch 62 is firmly held in place.

A float 68 is concentrically disposed about the stem 64. As shown, the float 68 includes a central bore 70. Preferably, the diameter of the central bore 70 is approximately 30 to 45 percent larger than the outer diameter of the stem 64. In this way the stem 64 effectively guides the float 68 keeping it from engaging the sides of the housing 20'. Sufficient clearance is also provided between the float 68 and stem 64 to prevent dirt and debris from building up therebetween. Thus, smooth operation of the float 68 is assured.

A pair of opposed magnets 72 are provided in the upper portion of the float 68. As the float 68 is buoyed upward by a rise in the liquid level, the magnets 72 become aligned with the reed switch 62 in the stem 64. When this occurs, the magnetic force produced by the magnets 72 in the float 68 serve to force the reeds in the switch 62 together, closing the circuit and starting the pump 60 as described in greater detail below. As the liquid level drops as a result of pumping, gravity draws the float 68 downwardly so that the magnets 72 are no longer aligned with the reeds of the switch 62 which then open. A cotter pin 73 or some other device in the end of the stem 64 engages the float 68 and limits its downward movement.

Preferably, the float 68 is formed of Nitrophyl material and is approximately 0.9 inches in diameter and 3.0 inches in length. Such a float 68 has sufficient buoyancy to close the reed switch 62 and complete the circuit to the pump 60 before the liquid level L reaches the upper portion of the float 68 including the magnets 72 (see also FIG. 5). In this way, any build up of ferrous particles about the float in the area of the magnets 72 is prevented.

Figure 2:
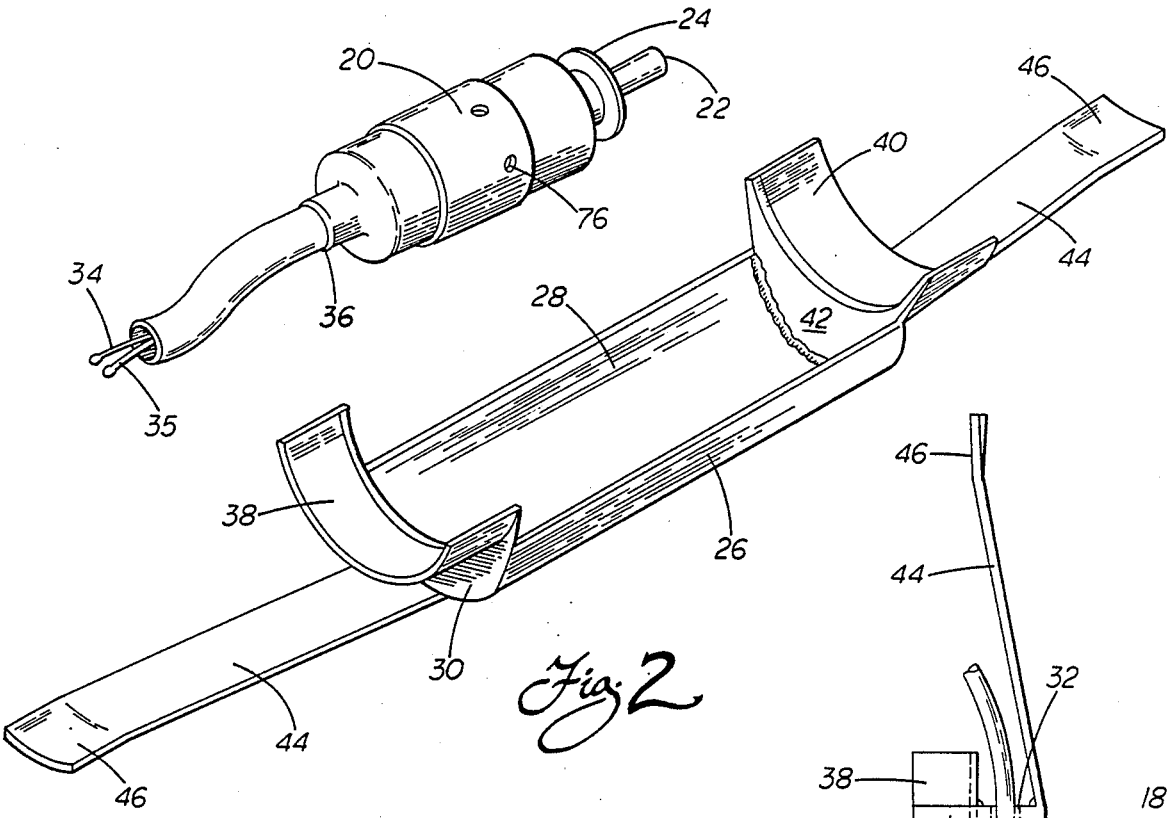
FIG. 2 is an exploded perspective view showing the level sensor switch and housing of the present invention.

As best shown in FIG. 2, the switch 18 is mounted within a protective inner housing 20 made of a non-ferrous material such as copper. Any known method of mounting may be utilized including the soldering or brazing of the bell top 66 of the switch 18 to the inner housing 20. The inner housing 20 includes a substantially closed lower end having a series of apertures 74 through which the liquid flows into the inner housing 20 to buoy the float 68. Additional apertures 76 toward the middle of the housing 20 prevent pressure from building within the housing as the liquid level rises (see also housing 20' shown in FIG. 5). A tip 22 at the lower end of the housing 20 houses a magnet. A non-ferrous, disc-shaped shield 24 is concentrically mounted about the tip 22 in a substantially perpendicular plane approximately 3 to 5 inches from the reed switch 62 of switch 18. Together, the magnet 23 in the tip 22 and the shield 24 serve to trap ferrous particles (such as produced previously during drilling) in the harsh environment of the shaft that might otherwise disrupt proper switch operation. More specifically, as the level of liquid in the shaft S rises, it contacts the magnetic tip 22. When this occurs, any fine ferromagnetic particles suspended in the liquid in the area between the working barrel 14 and outer protective housing 26 (see also FIG. 1) are drawn toward and held in contact with the tip 22. As the liquid level rises further, the magnetic tip 22 and shield 24 serve to prevent the ferromagnetic particles from rising above the shield in the area of the switch 18 thereby preventing the particles from plugging the holes 14 and/or building up around the stem 62 and float 68 and adversely affecting the operation of the switch.

Figure 3:
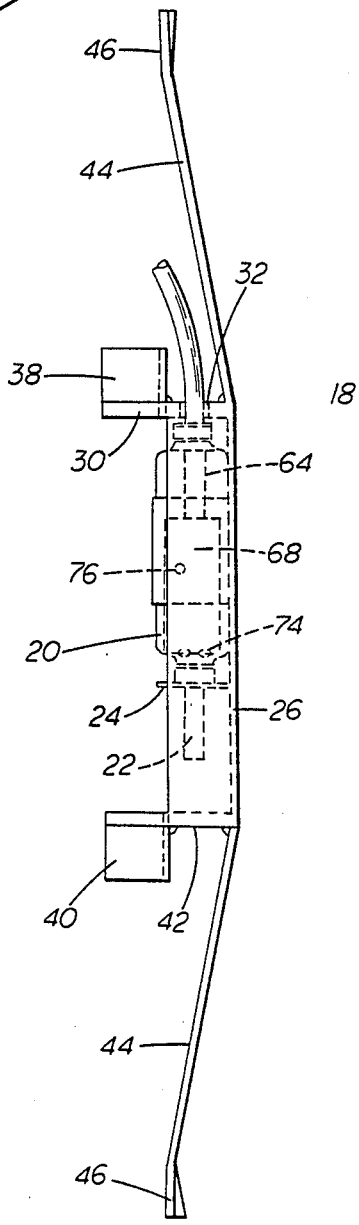
FIG. 3 is a side elevational view of the level sensor switch and housing.
Figure 7:
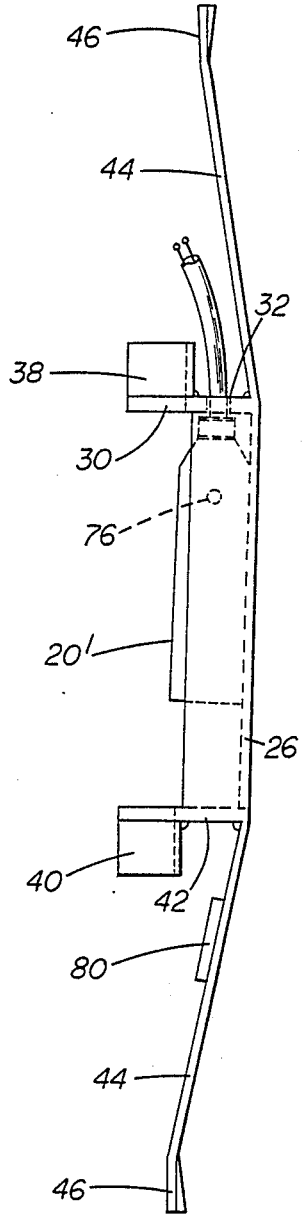
FIG. 7 is a side elevational view of the level sensor switch shown in FIG. 5 mounted within an outer housing.
Figure 6:
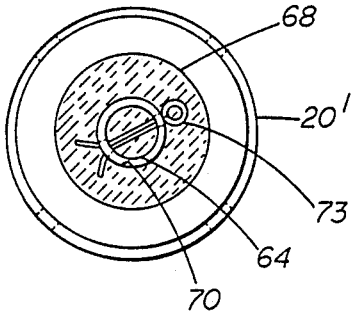
FIG. 6 is a bottom plan view of the float switch shown in FIG. 5.

In the alternative embodiment shown in FIGS. 5 and 6, the switch 18 is mounted within an inner housing 20' (constructed of, for example, stainless steel) having an open bottom end. More specifically, the switch 18 may be positioned within the housing 20' with the bell top 66 of the switch providing an interference fit with the upper portion of the housing. Advantageously, the open bottom end of this housing 20' significantly reduces the possibility of clogging so as to provide more reliable performance under all operating conditions. Further, as shown in FIG. 7, a bar magnet 80 may be welded to the outer housing 26 approximately 6.5 to 8.5 inches below the reed switch 62 to draw any fine ferromagnetic particles suspended in the liquid in the area of the switch 18 away from the switch. Thus, these particles are prevented from reaching the switch 18 and adversely effecting its operation as described above with respect to the embodiment shown in FIGS. 1-3.

The switch 18 and surrounding inner housing either 20, 20' are received and held (as for example by welding) in a recess 28 formed in the outer housing 26. The outer housing 26 is made of hard steel to protect the switch 18 from impact damage. In particular, the outer housing 26 prevents the switch 18 from directly contacting the walls of the shaft S as the string 12 and switch 18 are positioned in the shaft. Further, the outer housing 26 protects the switch 18 during its residence time in the shaft S as well.

The outer housing 26 includes one end wall 30 having an aperture 32 through which the power input line 34 and timer control line 35 pass (note also aperture 36 in inner housing 20). A substantially U-shaped mounting bracket 38 is mounted to the end wall 30. Similarly, a substantially U-shaped mounting bracket 40 is mounted to the end wall 42. Mounting lugs 44 are also provided at each end of the outer housing 26. Each mounting lug 44 extends from the outer periphery of the casing and passes over the substantially U-shaped mounting brackets 38, 40 (see FIG. 3). Mounting tabs 46 are provided at the distal end of each mounting lug 44.

As shown, the mounting lugs 44 converge toward the mounting brackets 38, 40 so that the brackets and mounting tabs 46 are substantially aligned. As should be appreciated from viewing FIG. 1, the aligned mounting brackets 38, 40 and tabs 46 are adapted to engage the cylindrical working barrel 14 of the production string 12. Individual band clamps 48 are utilized to encompass each of the mounting brackets 38, 40 and mounting tabs 46 as well as the working barrel 14. The band clamps 48 are then tightened to fix both the outer housing 26 and level sensor switch 18 to the working barrel 14 at the desired location above the top of the intake tube 16. Typically, the level sensor switch 18 is located approximately 12"-60" above the upper apertures in the intake tube 16.

Over time, subterranean pressures cause liquid including crude oil to flow into the shaft S. Eventually, the level of liquid L in the shaft S rises to the level sensor switch 18. When this occurs, the float 68 is buoyed upwardly from the dashed line position to the full line position shown in FIG. 5 until the magnets 72 are brought into alignment with the reed switch 62. This causes the reeds 62 to come together and close the circuit. The closing of the switch 18 serves to complete the circuit from the 120 volt power source 54, through the stepdown transformer 56 (120 V to 24 V), power input line 34 and timer control line 35. This activates the adjustable timer 50 in the control circuit 52 (see FIG. 4).

Figure 4:
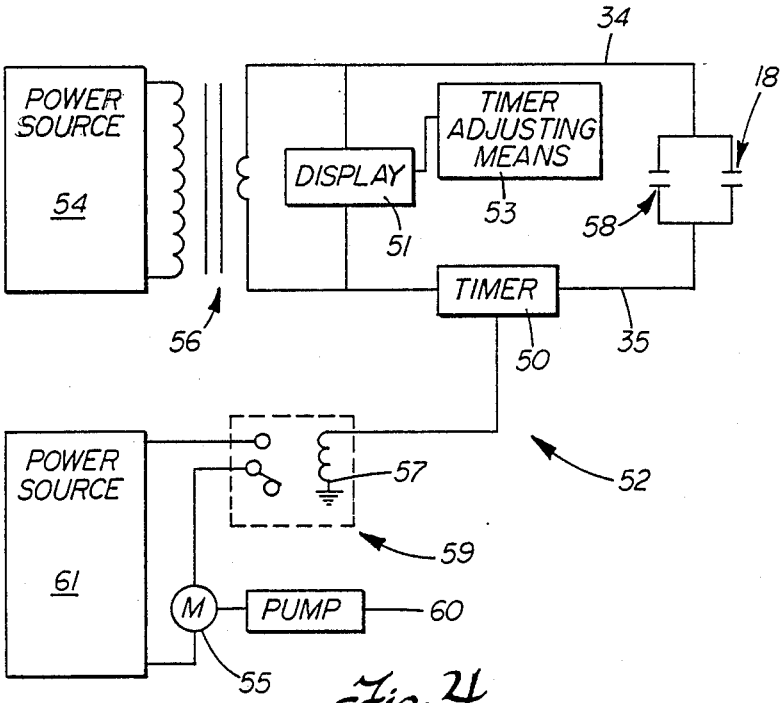
FIG. 4 is a schematic diagram of an exemplary electrical control circuit of the present invention.

A number of adjustable timers 50 presently available in the marketplace may be utilized within this circuit 52. For example a model H3CA as manufactured by Omron Tateisi Electronics Co. of Japan may be utilized. Such a timer 50 includes an output display 51 and a series of push button thumbwheel switches 53 (both shown schematically in FIG. 4) to allow the time of operation of the timer 50 to be adjusted as desired. Advantageously, a large portion of the control circuit 52 including the power source 54, stepdown transformer 56, a manual switch 58 (for overriding the timer and manually activating the pump 60) and adjustable timer 50 are all located above ground level. As such, these components are not exposed to the harsh environment within the oil well shaft S. Consequently, the service life of these components is increased and, therefore, so is the Once, the adjustable timer 50 is activated, the circuit to the drive motor 55 for the pump 60 is closed. More specifically, as shown in FIG. 4, activation of the timer 50 causes energization of the coil 57 of relay 59. This causes the normally open relay 59 to close (see dashed line position) and complete the circuit between the 220 volt power source 61 and the pump motor 55. This circuit stays closed as long as the timer 50 is timing out and energizing the coil 57. During this time the pump 60 is operative to recover and pump liquid from the shaft S through the intake pipe 16, working barrel 14 and production string 12 to the storage facility. The pump 60 continues to operate until the adjustable timer 50 times out. At that moment, the coil 57 is de-energized, the relay 59 returns to its normally open position (note full line) and the pump motor 55 is disconnected from the power source 61 so that pump operation is discontinued.

The period of operation of the pump 60 during each pumping cycle may be adjusted to meet any specific needs or requirements relative to the shaft S from which crude oil is being pumped. In, particular, the timer 50 may, for example, be set utilizing the adjusting mean 53 to provide a twenty minute pumping cycle every time the liquid level in the well shaft S reaches and closes the sensor switch 18. Since the pump 60 operates at constant capacity, it will pump an identical volume of liquid from the well each twenty minute cycle. As such, at the end of each pumping cycle, approximately the same amount of liquid remains in the well shaft. The liquid remaining in the shaft may be maintained intentionally to exert a desired static pressure on the producing strata.

Alternatively, the timer 50 may be adjusted so that the liquid level remaining in the shaft S after each pumping cycle is just above the upper apertures in the intake pipe 16. In this way, the maximum amount of liquid and crude oil is pumped from the shaft S during each cycle. Further, no energy is wasted by operating the pump 60 when any apertures of the intake pipe 16 are exposed to air. Consequently, maximum efficiency and production from a well is obtained while energy consumption is reduced. Further, it should be appreciated the control system 10 automatically alters the cycling of the pump to match any variance in flow of liquid from the producing strata as may occur from season to season, month to month or even week to week. Thus, peak operating efficiency of the pump is maintained by the control system 10 of the present invention at all times.

In summary, numerous benefits have been described which result from employing the concepts of the present invention. The control system 10 of the present invention provides for more reliable and dependable operation of a pump 60 at maximum efficiency at all times. Only one level sensor switch 18 is provided in the harsh environment of the oil well shaft S. The switch 18 is well protected from any impact damage by a sturdy outer housing 26 and an inner housing 20. An adjustable timer 50 and other components of a control circuit 52 are provided above the ground where they can be protected from the elements and may be easily serviced and maintained. Further, it should be appreciated that the adjustable timer 50 allows the operator to control the production from the well as necessary and in accordance with fluctuating activity of the producing strata to provide maximum performance of the pump 60 and therefore maximum production efficiency at all times. When necessary, a manual override switch 58 may also be utilized to provide manual control and operation of the pump when desired.

The foregoing decription of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. A control system for a pump adapted for pumping liquid from an oil well shaft through a production string comprising:

a control circuit including timing means remotely located from said oil well shaft, said timing means maintaining operation of said pump for a predetermined period of time so as to pump a selected volume of liquid from said well and maintain substantially the same volume of liquid in said well at the end of each pumping cycle;

means for sensing the liquid level in said oil well shaft and actuating said timing means in response to said liquid rising to a predetermined level; and means for protecting said level sensing means from impact damage when said level sensing means is positioned in said oil well shaft.

2. The control system set forth in claim 1, wherein said level sensing means comprises only a single float switch.

3. The control system set forth in claim 1, wherein said protecting means includes an outer housing having a recessed cavity for receiving and holding said level sensing means.

4. The control system set forth in claim 3, wherein a substantially U-shaped mounting bracket is provided at each end of said outer housing for engaging said production string.

5. The control system set forth in claim 4, wherein a mounting lug depends from an outer periphery of said outer housing at each end, each lug extending over and converging toward said U-shaped mounting brackets associated with said ends; said mounting lugs each including a mounting tab for engaging said production string.

6. The control system set forth in claim 5, further including clamping means for fixing said protecting means to said production string.

7. The control system set forth in claim 6, wherein said clamping means is a band clamp.

8. The control system set forth in claim 7, wherein one band clamp engages each U-shaped mounting bracket and each mounting tab as well as said production string.

9. The control system set forth in claim 1, further comprising an inner housing, said inner housing including a tip portion housing a magnet, a body portion housing said level sensing means and a shield between said tip and body portions.

10. The control system set forth in claim 9, wherein said shield is concentrically disposed about an end of said tip portion and said inner housing is formed of non-ferrous material.

11. The control system set forth in claim 1, further comprising means for drawing ferromagnetic particles suspended in said liquid in said well shaft away from said liquid level sensing means so as to prevent said particles from building up around said liquid level sensing means and adversely affecting control system operation.

12. The control system set forth in claim 11, wherein said liquid level sensing switch is a float switch and further comprising an inner housing having an open bottom end to allow free communication between said float switch and said liquid in said well shaft.

* * * * *